US009856691B2

(12) United States Patent
Nielsen et al.

(10) Patent No.: US 9,856,691 B2
(45) Date of Patent: Jan. 2, 2018

(54) SLIDING WINDOW ASSEMBLY

(71) Applicant: Aneeta Window Systems (Vic) Pty Ltd, Mitcham (AU)

(72) Inventors: Lars Søgaard Nielsen, Melbourne (AU); Richard James Mckenna, Melbourne (AU)

(73) Assignee: JELD-WEN, Inc., Klamath Falls, OR (US)

( * ) Notice: Subject to any disclaimer, the term of this patent is extended or adjusted under 35 U.S.C. 154(b) by 0 days.

(21) Appl. No.: 14/976,283

(22) Filed: Dec. 21, 2015

(65) Prior Publication Data

US 2016/0186484 A1 Jun. 30, 2016

(30) Foreign Application Priority Data

Dec. 22, 2014 (AU) ..... 2014905198

(51) Int. Cl.

| | |
|---|---|
| ***E05F 11/00*** | (2006.01) |
| ***E06B 3/44*** | (2006.01) |
| ***E06B 7/23*** | (2006.01) |
| ***E06B 7/24*** | (2006.01) |
| *E06B 3/08* | (2006.01) |
| *E06B 3/26* | (2006.01) |

(52) U.S. Cl.

CPC ..... *E06B 3/44* (2013.01); *E06B 7/2305* (2013.01); *E06B 7/24* (2013.01); *E06B 3/08* (2013.01); *E06B 2003/262* (2013.01); *E06B 2003/4461* (2013.01); *E06B 2003/4476* (2013.01)

(58) Field of Classification Search

CPC ..... E06B 3/44; E06B 7/2305; E06B 7/24

USPC ..... 49/358, 447

See application file for complete search history.

(56) References Cited

U.S. PATENT DOCUMENTS

| | | | | |
|---|---|---|---|---|
| 208,926 | A * | 10/1878 | Rebhun | E06B 3/44 49/447 |
| 2,798,578 | A | 7/1957 | Toth | |
| 3,065,507 | A | 11/1962 | Cloutier et al. | |
| 3,324,597 | A * | 6/1967 | Rich | E06B 3/4618 160/90 |
| 3,377,747 | A * | 4/1968 | Donkin | E06B 3/44 49/414 |
| 4,064,653 | A | 12/1977 | Randall et al. | |
| 4,202,137 | A * | 5/1980 | Randall | E06B 3/4609 49/458 |

(Continued)

*Primary Examiner* — Jerry Redman
(74) *Attorney, Agent, or Firm* — Stoel Rives LLP

(57) ABSTRACT

A sliding window assembly (35) including a window frame and at least two glass panes (38, 39). At least one of the glass panes (38, 39) slides within the frame between an open position and a closed position, wherein one of the edges of each pane overlaps to form overlapping edges (42, 43). First and second rails (44, 45) are connected to the overlapping edges (42, 43) and cooperate to form a seal between them in the closed position. Each rail (44, 45) is formed from a metal component (46) and a plastic component (51) that are formed separate from each other and are assembled in nesting connection. The seal in the overlap between the overlapping edges (42, 43) in the closed position of the panes (38, 39) is formed between the plastic components (51) of the first and second rails (44, 45). The metal components (51) of the first and second rails (44, 45) are spaced from contact with each other and extend to overlie outwardly facing surfaces of the first and second panes (38, 39).

20 Claims, 7 Drawing Sheets

(56) References Cited

U.S. PATENT DOCUMENTS

| | | | | | |
|---|---|---|---|---|---|
| 4,227,346 | A * | 10/1980 | Kubik | E05D 15/565 | 49/425 |
| 4,398,373 | A * | 8/1983 | Mancuso | E06B 3/4618 | 49/425 |
| 4,667,441 | A * | 5/1987 | Coddens | E06B 3/4609 | 49/404 |
| 4,726,147 | A * | 2/1988 | Beske | E06B 3/4609 | 49/406 |
| 4,827,685 | A | 5/1989 | Schmidt | | |
| 4,922,658 | A * | 5/1990 | Coddens | E06B 3/4609 | 49/458 |
| 5,274,955 | A * | 1/1994 | Dallaire | E06B 3/44 | 49/406 |
| 5,446,997 | A * | 9/1995 | Simonton | E06B 3/44 | 49/406 |
| 5,649,389 | A * | 7/1997 | Coddens | E05D 15/22 | 49/176 |
| 5,791,700 | A * | 8/1998 | Biro | E05C 9/043 | 292/36 |
| 7,716,875 | B2 | 5/2010 | Langner | | |
| 8,191,313 | B2 * | 6/2012 | Ito | E06B 3/50 | 49/176 |
| 8,869,453 | B1 * | 10/2014 | Jordan | E06B 3/4407 | 49/404 |

* cited by examiner

SLIDING WINDOW ASSEMBLY

TECHNICAL FIELD

This disclosure relates to sliding window assemblies which comprise a frame and at least two panes, at least one of which is a sliding pane within the window frame. Embodiments of the invention have been developed in relation to sliding windows that include glass panes with or without framing attached to the pane as well as panes that are formed of two or more panes of glass and which are known for example as "double" or "triple" etc. glazed panes.

Embodiments have also been developed in relation to sliding windows in which the sliding pane or panes slide vertically, and it will be convenient to describe the invention in relation to that form of sliding window. However, it is to be appreciated that the invention could also apply to windows in which the sliding pane or panes slide horizontally.

Vertical sliding windows come in different types and the types can be known as double hung, counterbalanced, single hung, and servery windows. These types of windows could be known by different names in different countries. The panes of glass referred to above that are either fully or partially framed, or completely frameless, are often referred to as "sashes" and where appropriate, that term will be used in the detailed description of the embodiments.

Fully framed sashes include a frame extending completely about the sash glazing. Partially framed sashes include frame members on one or more edges, but not on all edges. For example, in vertical sliding windows, the side edges of the sash glazing can have "stiles" or "slides" attached to the side edges which interact with vertical frame members of the window frame ("jambs") to guide the sash glazing vertically within the frame. In horizontal sliding windows, a "bottom rail" can be fixed to the bottom edge of the sash glazing and the bottom rail interacts with the bottom or sill of the window frame to guide the sash horizontally within the frame. Fully frameless sashes have no members attached to the edges of the glazing.

BACKGROUND

The following discussion of the background to the invention is intended to facilitate an understanding of the invention. However, it should be appreciated that the discussion is not an acknowledgement or admission that any of the material referred to was published, known or part of the common general knowledge as at the priority date of the application.

Sliding windows of the kind envisaged by the present inventors are those that form a barrier between the interior and exterior of a building such as a house or apartment, or a commercial building. Sliding windows conveniently allow the window to be opened to allow air flow through the opening into or out of the building. A difficulty with sliding windows is that they can present various insulation problems, including that they are often difficult to seal and therefore are associated with undesirable airflow through or past parts of the window assembly that slide. This includes the sections of the sashes that overlap in the closed position of the sashes, i.e. the upper edge of a bottom sash and the lower edge of an upper sash.

Another insulation problem that exists with sliding windows is that of thermal conduction of both heat and cold between the inside and outside the building to which the windows are fitted. For this reason, sliding windows have included thermal breaks in the window construction between outside facing portions of a window and inside facing portions, in order to disrupt the conduction of heat or cold through the window from outside to inside and vice versa.

The use of thermal breaks can have a positive effect on the insulation properties of a building, but the manner in which thermal breaks have been provided to date has caused difficulties in maintaining the aesthetic appearance of a window, as well as causing difficulties in the manufacture of the components in which the thermal breaks are provided. The present inventors have recognized a need for an improved sliding window assembly to allow the inclusion of thermal breaks in windows either without affecting, or at least reducing the effect of the appearance of the window and/or to enable the components in which the thermal breaks are provided to be more easily manufactured and assembled compared with the prior art.

SUMMARY

According to the present disclosure there is provided a sliding window assembly including:

a window frame and at least two glass panes, at least one of which is a sliding pane which slides within the window frame between open and closed positions, wherein the panes are square or rectangular and have a first pair of parallel edges and a second pair of parallel edges generally perpendicular to the first pair of parallel edges, whereby in the closed position one of the edges of the first pair of parallel edges of each pane overlaps to form overlapping edges, first and second rails being connected to the overlapping edges of the panes and the first and second rails cooperating to form a seal between them in the closed position of the panes, each rail being formed from a metal component and a plastic component, the metal and plastic components being formed separate from each other and being in nesting connection to form each rail, the seal which is formed between the first and second rails being formed between the plastic component of the first and second rails in the overlap between the overlapping edges in the closed position of the panes, the metal components of the first and second rails being spaced from contact with each other and extending to overlie outwardly facing surfaces of the first and second panes.

Embodiments have been developed principally for vertically sliding windows and therefore, in a more specific embodiment, there is provided a sliding window assembly including:

a window frame and at least two glass panes, at least one of which is a sliding pane which slides vertically within the window frame between open and closed positions, wherein in the closed position the panes form an upper pane and a lower pane and an upper edge of the lower pane overlaps with a lower edge of the upper pane, first and second rails being connected to the respective upper and lower edges of the upper and lower panes and the first and second rails cooperating to form a seal between them in the closed position of the panes, each rail being formed from a metal component and a plastic component, the metal and plastic components being formed separate from each other and being in nesting connection to form each rail, the plastic component of the first and second rails interengaging in the overlap between the upper and lower panes in the closed position of the panes to form the seal between the first and second rails, the metal components of the first and second rails being spaced from contact with each other and extending to overlie outwardly facing surfaces of the first and second panes.

A window assembly according to some embodiments advantageously provide a thermal break in the engaged condition of the first and second rails by the spacing of the metal components, so that thermal transfer through the rails is minimised. In the above described arrangement, the metal components do not come into contact but rather, those components are separated by plastic components that can have a much lower thermal conductivity than the metal components. Contact between the plastic components does not cause a thermal transfer of any significance and therefore can be tolerated. In some prior art arrangements, the first and second rails are formed completely from metal, and when they are engaged or at least close to each other in the closed condition of the panes, thermal transfer readily occurs from one side of the rails to the other, so that in practice, the thermal transfer occurs from outside a window to inside a building or dwelling, or the other way around.

In other forms of prior art, the first and second rails have been made completely from plastic, and while those forms of rails can provide good thermal insulation, they are not as desirable as metal rails, either aesthetically or structurally. Metal, particularly aluminium, can be coloured, such as by painting or powder coating, to produce an aesthetically pleasing and durable look that can withstand weathering. Metal, particularly aluminium, is therefore the preferred material for rails from an aesthetic and durability point of view, whereas plastic is the preferred form of material in respect of reducing thermal conductivity.

Embodiments disclosed herein may therefore allow the first and second rails to have both an acceptable aesthetic appearance and durability, while also providing an adequate thermal rating which is improved over prior art rails. Moreover, the connection between the metal and plastic components in rails according to the present disclosure can be made easily and without specialised skill or equipment.

The prior art also includes combined aluminium and plastic rails, but the manner in which those rails have been manufactured has meant that the aluminium component has been difficult to paint or powder coat as required for a good aesthetic finish. Prior art arrangements have employed a rolling technique to roll the aluminium metal component onto the plastic component and that arrangement occurs prior to the aluminium being painted or powder coated. Painting or powder coating has to occur after rolling the aluminium component onto the plastic component, because the rolling step will damage the painted or powder coated finish of the aluminium component. Compared to embodiments of the present disclosure, the prior art requires a larger metal component due to the need for greater strength under the rolling operation, and therefore the prior art arrangements tend to use more material than the embodiments disclosed herein.

In addition, powder coating the rails after the metal component has been connected to the plastic component is problematic, as powder coating of a metal component would normally take place at an elevated temperature, but if the metal component is already connected to a plastic component, the powder coating must be undertaken at a lower and less desirable temperature in order not to distort the plastic component. This can result in a finish that is not as aesthetically pleasing as if the powder coating had been applied at the correct temperature.

Because embodiments disclosed herein allow the metal component to be painted or powder coated or otherwise treated before it is connected to the plastic component, the metal component can have any suitable finish and the finish can be applied under optimum conditions. This ensures that the metal component can have an aesthetically pleasing appearance.

The nesting connection between metal and plastic components of the rails can include any suitable nesting connection, but the expected method of connection is by clip or snap-fit connection. An alternative form of connection could be sliding connection, where the plastic component is slid into connection with the metal component and once slid to its final position, the final nested connection is made.

Either of the above forms of nesting connection provide significant advantages, given that the metal component can be treated as described above prior to connection with the plastic component. Moreover, connection of the treated metal components with the plastic component is easy and requires minimal skill and no special tools or tooling. Clipping in particular is fast and effective and one method involves clipping the plastic component into the metal component at one end of a rail and thereafter applying joining pressure progressively along the rails to the opposite end so that the metal and plastic components progressively clip together from one end to the other. This is most suitable to arrangements where the nesting connection is made along the complete length of the rail. In other arrangements, the nesting engagement can be at discrete positions or sections of the rail and for example, snap-fit connectors can be spaced apart along the length of the rail for snap connection between the metal and plastic components. Snap-fit or sliding connections can comprise male/female connections, or recess sections that receive and retain a projection, section or member therein. Plug connections are within the scope of the present disclosure (and can be a snap-fit connection) where one of the metal or plastic components includes a spigot, boss or plug, that extends into and therefore nests within an opening formed in the other of the metal or plastic components. Clearly other arrangements exist that fall within the scope of the requirement of a nesting connection between the metal and plastic components.

The aesthetic requirement for metal components, in particular aluminium components, is to improve the aesthetic appearance of upper and lower edges of the panes within the sliding window assembly by forming a cover over the edge of the upper and lower edges. Such a cover can conceal sealing components between the overlap between panes and provide a portion to grip to lift or lower the panes. Side edges of the panes can also be improved by the use of aluminium covers. Traditionally, this improved appearance has been provided by a section of aluminium that overlies the outwardly facing or visible surfaces at the upper and lower edges of the sliding panes. The cover can extend for any suitable depth over the edges and normally would be between 2 and 4 cm. Effectively, the overlying aluminium provides a border or frame for the upper and lower edges of the sliding pane. This look has found significant acceptance over many years and continues today. Accordingly, in many embodiments, the metal component of each rail comprises a first section which extends laterally to a second section. The first section is configured to overlie an end edge surface of a pane, being the upwardly or downwardly facing edge surface, while the second section overlies the adjacent and outwardly facing surface of the pane, which is usually perpendicular to the end edge surface and which is the surface that is visible to a person that views the pane. The first and second sections can extend perpendicular to each other, or close to perpendicular, such as at an angle of between 5° and 15°.

In the above arrangement, the first section of the metal component that overlies the end edge of a pane, can be in nesting connection with the plastic component. The second section of the metal component can lie flush against, or at least very close to, the outwardly facing surface of the pane.

Alternatively, the first and second sections of the metal component can nest with the plastic component.

In order for the first and second rails to have the most compact form possible, the first section of the metal component can have an inner face that faces the end edge surface of the pane and the plastic component can be in nesting connection with that inner face. For this, the inner face can define a nesting connection, such as a recess which is defined by a longitudinally and spaced apart end walls and a portion of the plastic component can extend into the recess and in cooperation with the end walls for nesting connection with the first section. One of the end walls can be located at the junction between the first and second sections of the metal component.

The inner face can define a different form of nesting connection, such as described above in relation to other forms of snap-fit connection or sliding connection.

The plastic component of each rail can also have a first section and a second section, whereby the first section extends laterally to the second section. In this arrangement, the first section can overlie an end edge of a pane and the second section overlies an inwardly facing surface of the respective pane. Thus, in some embodiments where each of the metal and plastic components have first and second sections, the first sections each overlie an end edge of a pane, while the second sections respectively overlie the outer and inner facing surfaces of the panes that extend from the end edge. When in nesting connection, the metal and plastic components thus form a channel into which the respective upper and lower edges of the upper and lower panes extend. The rails are thus connected to the respective upper and lower edges by receipt of the edges within the channels, while the plastic components also operate to inter-engage in the closed position of the panes in the region of overlap between a pair of panes or sashes in the closed position to seal between the sashes.

In an alternative embodiment, the plastic component forms a C-shaped channel for receipt of an end edge of a pane and the metal component is fixed to the plastic component by a snap fit. The C-shaped channel thus includes the first and second sections described above, and a third section that extends from the first section and that overlies the outer facing surface of a pane. The plastic component can be fixed to the pane by adhesive at any one of the sections of the C-shaped channel. In a simple arrangement, the metal component overlies the plastic component so that the plastic component is between the pane and the metal component and the metal component connects to the plastic component by engaging the end of the third section of the C-shaped channel of the plastic component that overlies the outer facing surface of a pane. The metal component can include a short flange or lip that extends inwardly towards the outer facing surface of the pane and which engages or bears against the free edge of the third section. In this arrangement, the metal component can completely cover the third section of the C-shaped channel of the plastic component, thus providing an aesthetically pleasing look.

The metal component can include a second point of connection with the plastic component and this can be made with the plastic component at one of the first or second sections of the C-shaped channel. For example, the plastic component can include a recess for receipt of a projection of the metal component. In one embodiment, the second point of connection is made close to the junction between the first and second sections of the C-shaped channel. The connection between the metal and plastic components can of course be made by other connection arrangements. The first and second rails cooperate to form a seal between them in the closed position of the panes and while this cooperation can be as simple as including brush seals or other types of seals that extend between the first and second rails, the preference is that the first and second rails actually have contacting inter-engagement in the closed position of the panes.

For inter-engagement, the second sections of the plastic components can define a recess between first and second walls and whereby inter-engagement is by receipt of a portion of the plastic components within the recess. In some embodiments, the portion of the plastic components that is received within the recesses is the second walls of the plastic components. That is, the recess formed between the first and second walls of one of the plastic components receives the second wall of the recess of the other of the plastic components upon relative sliding movement between two panes or sashes to the closed position of the panes or sashes.

Alternatively, the plastic components can include a different member for receipt within the recess in the closed position of the panes or sashes, but by having the second wall of one of the rails received within the recess of the other rail, an additional component for receipt within the recess is not required and the bulk of the rails is minimised.

The recesses can be formed in a V-shape and can be arranged so that upon reaching the closed position, the respective second walls of the recesses are in touching engagement or contact. This assists to seal between the respective first and second rails. Further seals can be employed as required to assist to weather proof the inter-engaging region between the first and second rails. For example, brush seals can be employed which are mounted to and extend from each plastic component into contact with the first walls of the recesses of the other component. Such seals can extend from a base portion of the plastic components from which the first and second walls extend.

The above described arrangement provides a seal between upper and lower edges of the respective panes that is highly weather proof against ingress or egress of both air and liquid, such as rain or dew. Moreover, the inter-engagement occurs naturally as the panes reach the closed position, while the rails remain relatively compact and unobtrusive.

The form of first and second rails described above, particularly the separately formed two-part construction whereby the metal and plastic components are in nesting connection, can also be employed in a modified form in each of the head and sill of the window frame. For example, the sliding window assembly can include a head which is formed from inner and outer metal plates or covers and a plastic connector to which each of the metal plates or covers is attached in spaced apart, generally parallel relationship. Like the first and second rails, the metal plates and the plastic connector are formed separate from each other and are in nesting connection. The metal plates or covers and the plastic connector form a channel into which a top edge of the pane is received. In this construction, the metal plates or covers are separated from each other so that thermal conductivity across the head is disrupted by the discontinuity between the metal plates or covers by the plastic connector and thus thermal conductivity is minimised. Nevertheless, the desired aesthetic appearance which is provided by the metal plate or cover which overlies an outwardly facing surface of the pane can be provided, while the opposite metal plate or cover can also form a cover for the opposite facing surface of the pane, or it can form a plate or a cover which extends across adjacent panes of the sliding window assembly. For example, some window assemblies might include a pair of panes, one of which is slidable and the other stationary, or in which both are slidable. In other arrangements, three or more panes are provided, in which two or more of the panes are slidable. The depth of the assembly therefore increases as more panes are provided and the aluminium cover extends across the entire width of panes.

It is to be noted that while reference above has been made to single panes, it should be understood that the present invention covers arrangements in which the panes or sashes are double glazed or triple glazed panes, so that the sliding pane might include two or three glazed panes or sheets which are connected together.

In another embodiment of the invention, a unique form of jamb arrangement is provided and this arrangement can be employed with the first and second rails, and the head and sill as described above, or it can be used independently of that arrangement in other sliding window arrangements. Thus, in a sliding window assembly according to the invention, the assembly can include a window frame and at least two panes, at least one of which is a sliding pane which slides vertically within the window frame between open and closed positions, the window frame including opposite side jambs that form a guide channel within which opposite side edges of a sliding pane is received, a pulley being mounted within each of the side jambs at an upper end of the guide channel and a cord extending about the pulley and into connection with the sliding pane.

A side jamb as above described is unique in that pulleys have not been employed as part of or a fixture of side jambs in the past. Rather, in the past, pulleys have been fixed to the external timber or metal frame within which the window assembly would be fitted. Thus, the side jambs would be connected to the external frame and openings would be made in the side jambs, either before or after fitting, and pulleys would thereafter be fixed to the external frame through the openings.

A disadvantage of the above prior art arrangement is that the manufacturers of the sliding window assemblies do not construct the external frame and thus there is reliance on the frame builder to properly construct the external frame and accurately place the pulley relative to the window assembly. Thus, the window assembly might be formed with openings in the side jambs for positioning of the pulleys, but if the frame constructor does not construct the external frame accurately, then the position of the pulleys can be compromised and that can affect the operation of the sliding panes. In contrast, the present invention enables the pulleys to be located in the side jambs of the window assembly and thus to be positioned as part of the manufacturing process of the window assembly. The pulleys can thus be accurately positioned for proper interaction with the sliding panes. Third party error is therefore eliminated.

Moreover, by fitting the pulley to the side jambs of the window assembly, the pulleys are fully installed and in connection with the sliding panes or sashes prior to the window assembly being fitted into an external frame. The installer therefore does not need to have any involvement in pulley installation and connection to the sliding panes or sashes and so this again ensures greater accuracy of pulley placement and easier installation. Moreover, a jamb according to the invention can provide greater support for the pulley by supporting the pin in which the pulley is mounted at each end rather than in a cantilever form as is employed in the prior art.

A still further advantage provided by this aspect of the invention, is that the cords or cables which engage the pulley and the sliding panes or sashes can be concealed within the side jamb and thus they are not evident or visible once the window installation is complete. In prior art arrangements, where the pulley is fixed to the external frame, often a cover is employed to overlie the cords or cables to obscure them from view. The present invention therefore renders the use of a cover redundant, as the cords or cables are already obscured.

The side jambs form a guide channel within which opposite side edges of sliding panes are received and the pulleys are mounted within each of the side jambs at an upper end of the guide channel and a cord or cable extends about the pulley and into connection with the sliding pane. To ensure that the cord or cable is obscured from view, the side jambs can define an outer wall and an inwardly opening channel, with the pulley being mounted intermediate the outer wall and the inwardly opening channel. For this, the side jambs can include a web between the outer wall and the inwardly opening channel and the pulley can be mounted within an opening formed in the web. Alternatively, a pair of webs can extend between the outer wall and the inwardly opening channel and the pulley can be mounted within an opening formed in the webs. The webs can form a hollow section such as a box section. A base part of the inwardly opening channel can be formed by a flange, and the arrangement can be such that the outer wall and the flange define a spaced apart channels within which the cords or cables on opposite sides of the pulley can run.

Side jambs according to the invention can be formed in a unitary manner or from a plurality of side jamb sections that interlock. In this latter arrangement, each jamb section can define a portion of a guide channel and the pulley can be mounted in one of the jamb sections that define the guide channel. A side jamb according to the invention can be made of plastic and the plastic can be the same plastic as used for the plastic component of the rails. The plastic can be any suitable plastic and can for example be a fibre reinforced plastic.

BRIEF DESCRIPTION OF DRAWINGS

In order that the invention may be more fully understood, some embodiments will now be described with reference to the figures in which.

DETAILED DESCRIPTION

Figure 1:
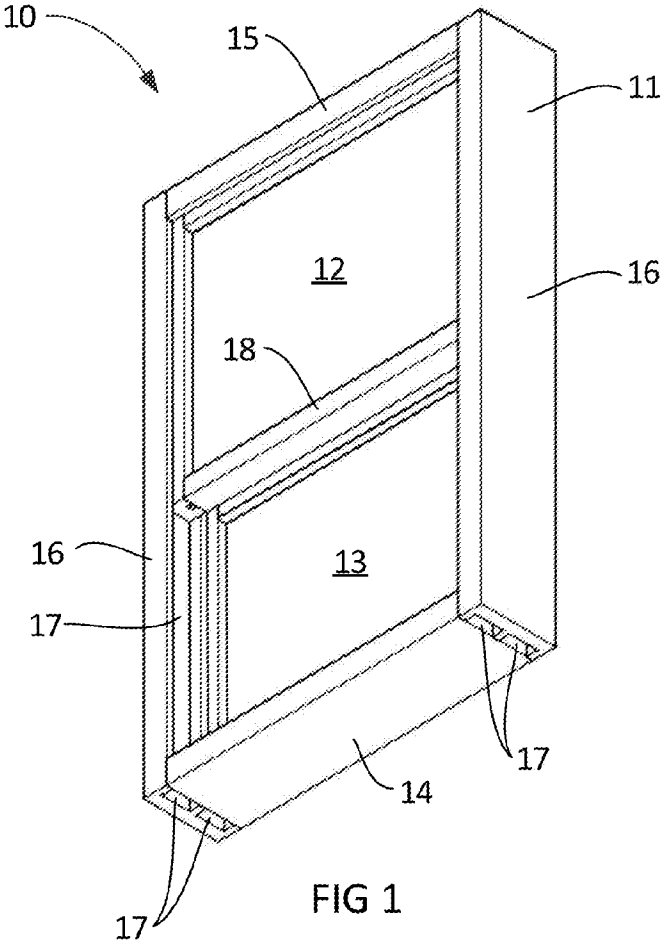
FIG. 1 is a perspective view of a sliding window assembly.

FIG. 1 illustrates a form of sliding window assembly in accordance with a first embodiment. The window 10 includes a rectangular frame 11 within which is disposed a pair of glass panes or sashes 12 and 13. For windows of the kind illustrated in FIG. 1, the panes are referred to as sashes and therefore that name will be used for that type of pane hereinafter. The rectangular frame 11 can be a wooden frame or metal, such as aluminium. While the sashes 12 and 13 of the embodiment of FIG. 1 are both slidable within the frame 11, in other embodiments (not shown) one of the sashes may be fixed and the other slidable.

The frame 11 comprises a sill 14 and a head 15. Side jambs 16 extend between the sill 14 and the head 15.

Each of the sill 14 and the head 15 is formed to define a pair of lengthwise channels to receive ends of the sashes 12 and 13 when the sashes are in the closed position of FIG. 1. In the closed position, the sash 12 forms an upper sash, while the sash 13 forms a lower sash. In the closed position, an upper edge of the sash 13 overlaps with a lower edge of the sash 12.

The sashes 12 and 13 are mounted to slide vertically within channels formed in the side jambs 16. One channel 17 is visible in FIG. 1 along the length of the side jamb 16, while the bottom ends of all of the channels 17 can be seen adjacent the sill 14. The channels act as guides to guide the sliding movement of the sashes 12 and 13. A lock can be used to prevent sliding movement in a closed or partially opened condition of the window 10.

In the window 10, a pulley, spring or weight arrangement can be employed so that the sashes 12 and 13 can maintain their position within the frame 11 in an open position of the sashes against gravity tending to pull each sash downwardly. Such systems are known already in the art.

Each of the sashes 12 and 13 of FIG. 1 includes a frame that extends about each of the four edges of the glazing or glass of the sash, but it is to be appreciated other embodiments may include sashes that do not have a frame or that have a partial rather than a full frame. As shown in FIG. 1, rails 18 and 19, known in the industry as "meeting rails", are connected to the respective upper and lower edges of the sashes 12 and 13.

Figure 2:
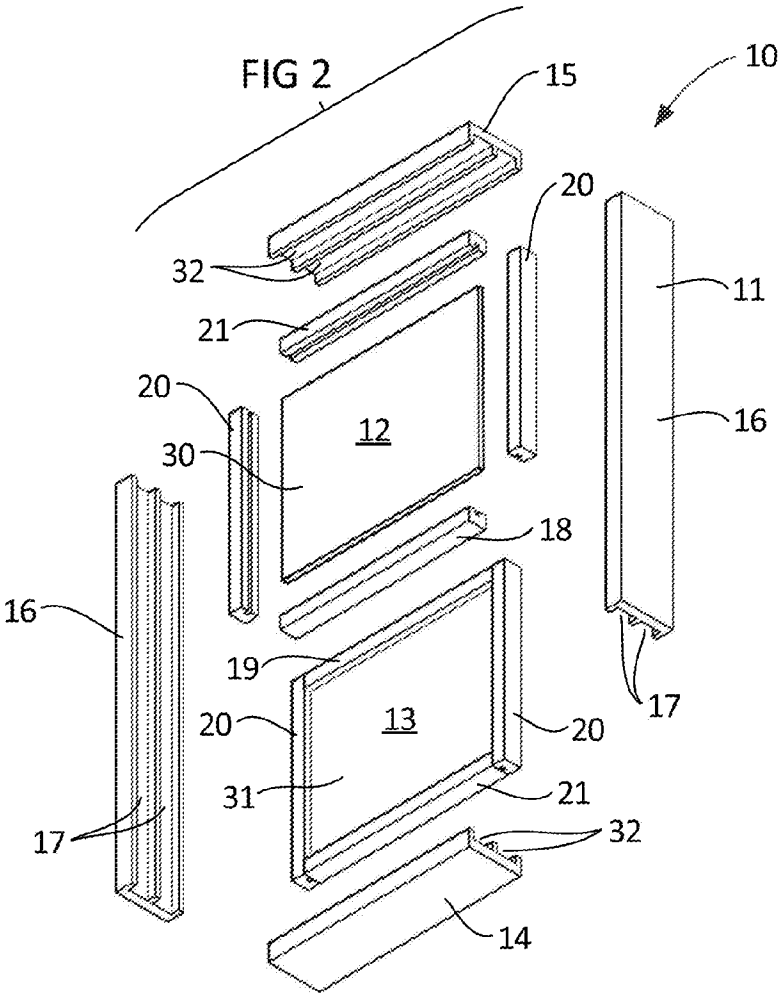
FIG. 2 is an exploded view of the window assembly of FIG. 1.

FIG. 2 is an exploded view of the window 10 of FIG. 1. In FIG. 2, the various components described and illustrated in FIG. 1 are shown, while FIG. 2 further shows in exploded view, the complete sash frame of the sash 12 which comprises side edge stiles 20, meeting rail 18 and top rail 21, each of which are fixed to the edges of the glazing 30 of the sash 12. The sash 13 also includes side edge stiles 20, meeting rail 19 and bottom rail 21, but they are shown in an installed position about the glazing 31 of that sash.

Further visible in FIG. 2 are channels 32 formed in the sill 14 and the head 15 and into which the top rail 21 of the sash 12 and the bottom rail 21 of the sash 13 enter when the sashes 12 and 13 are in the closed position shown in FIG. 1.

With the frame 11 of the window 10 assembled in the form illustrated in FIG. 1, the sashes 12 and 13 can slide conveniently within the frame 11 between open and closed positions. In the open position, insulation qualities of the window are irrelevant, however in the closed position, insulation can be important. Thus, insulation between the sill 14, the head 15 and the side jambs 16 is desirable. Moreover, the ability to provide insulation between the facing meeting rails 18 and 19 is relevant to improving the insulation qualities of the window.

In the embodiment illustrated in the figures, the meeting rails 18 and 19 include both a thermal break for insulation purposes, while the construction is a two-part construction comprising both a metal component, generally an aluminium component, and a plastic component, which nest together by either a snap-fit or sliding arrangement. By this arrangement, as will become clear from the following discussion, introduction of the thermal break does not detract from the aesthetic appearance of the meeting rails.

Figure 4:
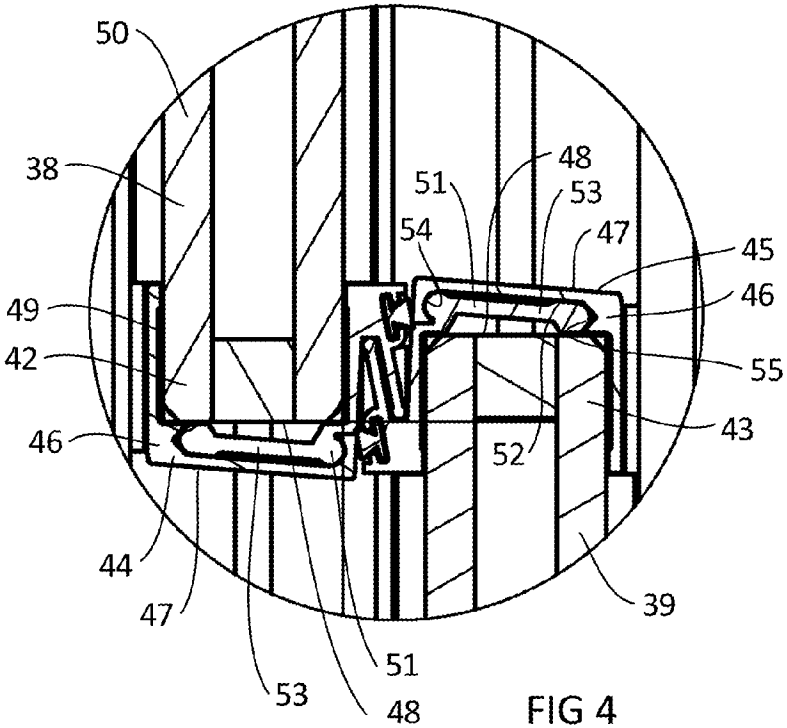
FIG. 4 is a detailed view of section D of FIG. 5.
Figure 3:
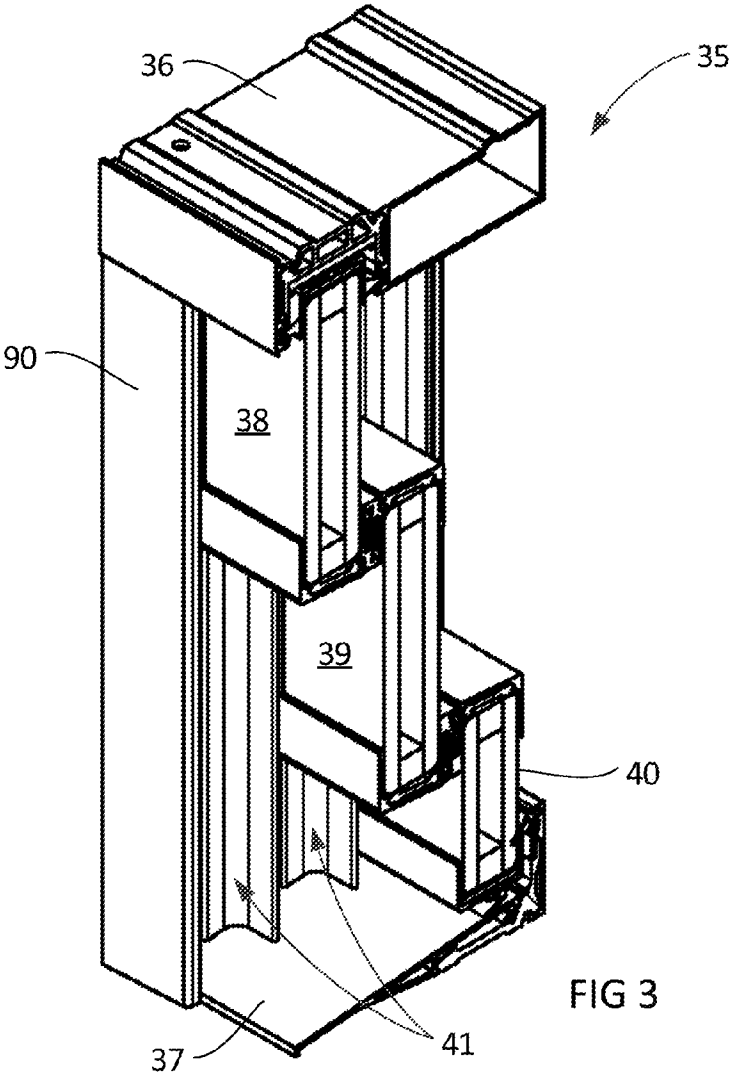
FIG. 3 is a cross sectional perspective view of a sliding window assembly according to the invention.
Figure 5:
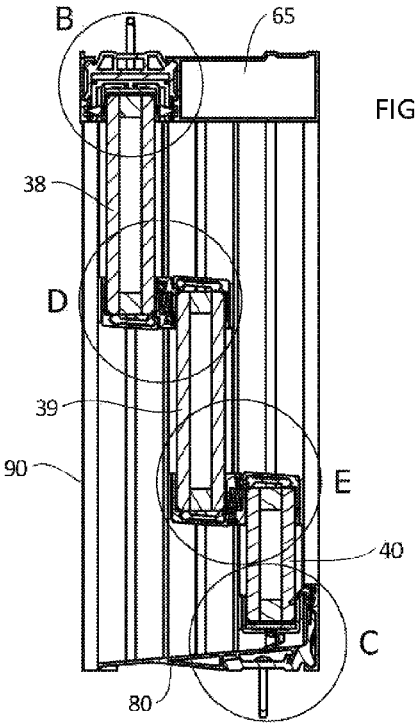
FIG. 5 is a side cross sectional view of the window assembly of FIG. 3.

In this respect, and with reference to FIG. 2, the frame or border of the sash 12, comprising the meeting rail 18, the stiles 20 and the top rail 21 can be formed from aluminium with a plastic or timber insert, with the aluminium presenting the outer or visible section of the components. The aluminium can be painted or powder coated to any suitable finish and the aluminium is normally formed in a C or U-shape that wraps around the edges of the glazing 30 from back to front. However, this continuous aluminium component is not thermally broken and therefore presents difficulties for insulation. In embodiments disclosed herein, the meeting rails are thermally broken as described below with reference to FIGS. 3 to 5. FIGS. 3 and 5 are an isometric cross sectional view and a side cross sectional view respectively of a window which includes three sliding sashes, while FIG. 4 which is a cross section through the meeting rail section D of FIG. 5 between two of the sliding sashes.

FIG. 3 therefore shows a window 35 which has a head 36 and a sill 37 and three double-glazed sashes 38 to 40. The sashes 38 to 40 have side edges captured in channels 41 (only two of which are visible in FIG. 3) and slide vertically within those channels. FIG. 4 is a cross sectional view taken through section D of FIG. 5. With reference to FIG. 4, upper sash 38 has a lower edge 42 that overlaps with an upper edge 43 of the lower sash 39. In that overlapping region, meeting rails 44 and 45 are attached respectively to the lower and upper edges 42 and 43 and the meeting rails and 44 and 45 inter-engage as will be now described.

The meeting rail 44 comprises an external aluminium component 46 which has a first section 47 that overlies an end edge 48 of the upper sash 38. The meeting rail further includes a second section 49, which extends laterally to the first section 47—not quite perpendicular thereto, but within 5-10° of perpendicular. The second section 49 overlies an outwardly facing or visible surface of the outwardly positioned glazing pane 50 of the sash 38, each of the outwardly facing surfaces facing away from the overlap between lower edge 42 of upper sash 38 and the upper edge 43 of the lower sash 39. The second section 49 may be connected to the pane 50 by an adhesive.

Interposed between the first section 47 of the aluminium component 46 and the end edge 48 of the sash 38, is a plastic component 51. Given that the construction of the meeting rails 44 and 45 is identical, the connection between the plastic component 51 and the aluminium component 46 will be described in relation to the meeting rail 45 only.

The aluminium component 46 is formed with a recess 52 which is shaped to receive a first section 53 of the plastic component 51. The first section 53 is interposed between the first section 47 of the aluminium component 46 and the end edge 48 of the sash 39. The first section 53 may rest directly against the end edge 48 of the sash 38.

The first section 53 of the plastic component 51 is either a snap or slide fit into nesting connection or engagement with the aluminium component 46. The preference is a snap-fit arrangement and the recess 52 is formed with undercut regions for that to occur. Thus, the opposite ends 54 and 55 of the recess 52 are undercut and curved complementary to the bulbous rails along the outer portion of the first section 53 of the plastic component 51 so that once the first section 53 has entered the recess 52, the section 53 is held within the recess and the resulting interlocking joint retains the aluminium component 46 on the pane 50. The first section 47 of the aluminium component 46 is sufficiently flexible to allow the recess 52 to be opened slightly to accept the first section 53 and to snap back from the flexed position to retain the first section 53. The first section 53 of the plastic component 51 may, thus, be considered a kind of modified dovetail shape for interlocking engagement with a correspondingly shaped recess 52 in aluminium component 46.

As previously indicated, by the arrangement of the joint between the aluminium component 46 and the plastic component 51 of each rail, the aluminium component 46 can be formed separately to the plastic component 51 and connected together prior to assembly of the window 10. This means that the aluminium component 46 can be produced and sent for painting or powder coating without being connected to the plastic component 51. This means that the process of painting or powder coating the aluminium component 46 is not affected by the existence of the plastic component 51. This represents a significant advantage and allows processing of the aluminium component 46, such as to paint or powder coat it, without limitations that would be imposed if the aluminium component 46 was already connected to the plastic component 51.

The respective components 46 and 51 can be connected together once they have been manufactured and thereafter, the meeting rails formed by the components 46 and 51 can be fixed to the relevant end of a sash or pane. The snap-fit connection which is preferred and illustrated in FIG. 4 provides a simple and easy form of connection between the components 46 and 51, although it will be equally appreciated that the components 46 and 52 could be connected together by sliding or other nesting connection.

Figure 6:
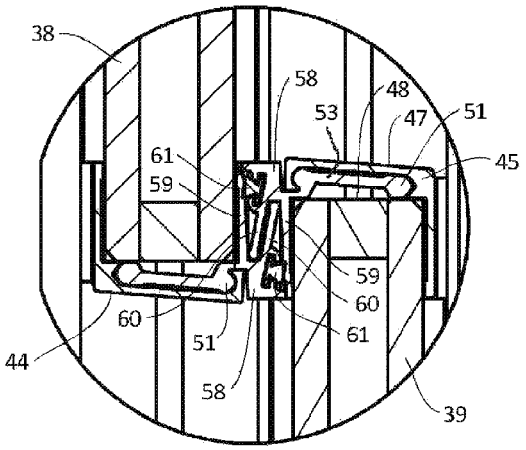
FIGS. 6 and 7 are detailed views similar to FIG. 4 but illustrating different configurations of meeting rails.

FIGS. 4 and 6 show meeting rails 44 and 45 inter-engaged in the closed position of the sashes 38 and 39. The construction of the plastic components 51 shown in the respective FIGS. 4 and 6 differs slightly but detailed discussion of the inter-engagement will be described in relation to the FIG. 6 illustration. FIGS. 4 and 6 show slightly different versions of meeting rails, but the same reference numerals have been used as in those figures for the same parts.

In relation to FIG. 6, each of the plastic components 51 includes the first section 53 as described above as well as a second section 58 (which is not included in the plastic components 51 illustrated in FIG. 4) which defines a recess or spacing formed between first walls 59 and second walls 60. The first and second walls 59 and 60 of the second sections 58 define a V-shaped recess and in the inter-engaged position of the meeting rails 44 and 45, the second walls 60 of each plastic component 51 are received within the V-shaped recesses of the other plastic component 51 and those second walls 60 of each plastic component 51 are in face to face engagement as shown. It will be appreciated that as the sashes 38 and 39 move from an open position to the closed position of FIG. 6, the second walls 60 will enter the V-shaped recesses and upon reaching the closed position, complete entry of the second wall 60 into the recesses is made. It can be seen from the cross section of FIGS. 4 and 6 that a substantial closure is made between the overlapping sections of the sashes 38 and 39 and this acts as a barrier against, or insulates against flow through the overlap, either from inside a building out, or outside the building in. To assist that barrier, seals 61 extend from a base portion of the components 51 and into engagement with a facing surface of the first walls 59.

Figure 7:
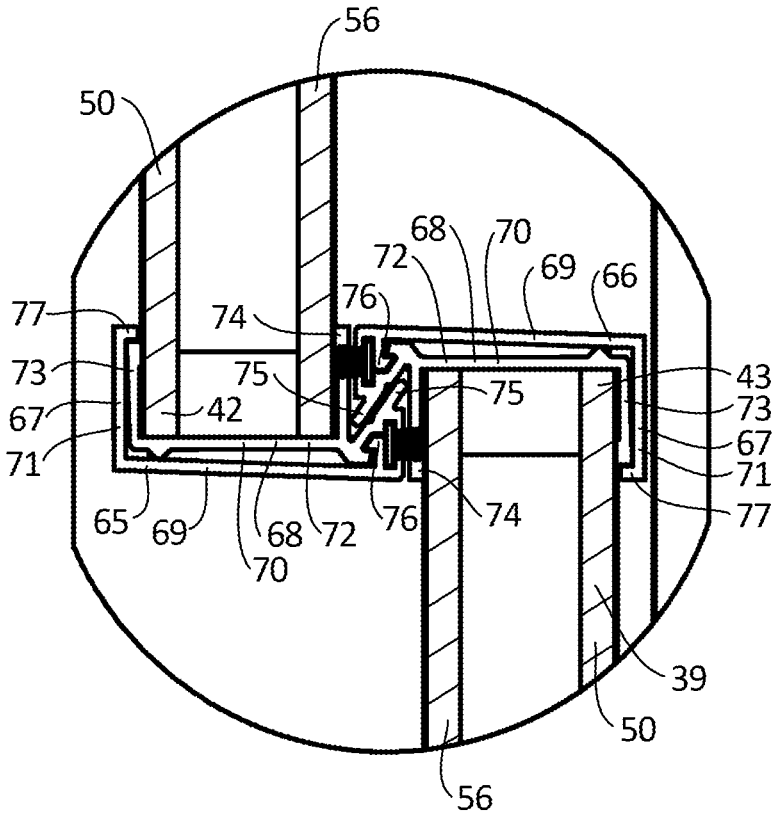

A further alternative meeting rail arrangement is illustrates in FIG. 7 and this figure again uses the same reference numerals that have been employed in FIGS. 4 and 6 where the same parts are included in FIG. 7. Thus, FIG. 7 shows sashes 38 and 39 in a closed position and shows meeting rails 65 and 66 attached to lower and upper edges 42 and 43 of the sashes 38 and 39.

The meeting rails 65 and 66 each comprise an external aluminium component 67 and an internal plastic component 68.

The aluminium component 67 includes a first section 69 that overlies an end edge 70 of the sash 38 and a second section 71 that extends laterally to the first section 69, not quite perpendicular thereto, but within 5° and 10°. The second section 71 overlies an outwardly facing surface of the outward positioned glazing pane 50 of the sashes 38 and 39.

The plastic component 68 likewise includes a first section 72 and a second section 73, which are perpendicular to each other. The first section 72 overlies the end edge 70 of a respective sash 38 and 39, while the second section 73 overlies an outwardly facing surface of the outward positioned glazing pane 50 of the sashes 38 and 39. The second section 73 can be adhesively fixed to the surface of the pane 50. The plastic component 68 further includes a third section 74, which extends perpendicular to the first section 72 of the plastic component 68 and which is generally parallel to the second section 73 of the same component. The plastic component 68 thus forms a C-shaped channel. The third section 74 can also be adhesively attached to the inwardly facing surface of the inwardly positioned glazing pane 75. In practice, either of the first or second sections 73 and 74 can be adhered to a surface of the respective panes 50 and 75, or just one of those sections can be adhesively secured.

The third section 74 of the plastic component 68 forms one wall of a V-shaped recess. The other wall of the V-shaped recess is formed by section 75 and it can be seen that in the closed position of the sashes 38 and 39 that the respective sections 75 enter the V-shaped recesses formed between the sections 74 and 75 and thus cooperate in a similar manner to the previous arrangements disclosed in FIGS. 4 and 6.

The major difference between the FIG. 7 arrangement and that shown in FIGS. 4 and 6, is that the plastic component 68 completely surrounds the sash edges 42 and 43 by the first, second and third sections 72 to 74 and the aluminium component 67 is a snap-fit onto the plastic components 68. In this respect, the free end 76 of the first section 69 of the aluminium component 67 is formed with a hooked or overhanging portion, to snap-fit into a corresponding recess or groove formed at the base of the V-shaped recess between the sections 74 and 75 of the plastic component 68. Concurrently, the free end 77 of the second section 71 is located to engage against the free end of the second section 73 of the plastic component 68, which nests within free end 77. These two connection points (at free ends 76 and 77) allow the aluminium component 67 to nest with the plastic component 68 by a snap-fit arrangement.

It is to be noted that in each of the arrangements of FIGS. 4, 6 and 7, that the closest sections of the respective aluminium components 67 of the meeting rails 65 and 66, are spaced apart at least about 8 mm. in FIG. 7 for example, the closest parts of the aluminium components are the free ends 76 and in practice, a gap between those free ends of about 8 mm provides a good or effective thermal break between the respective aluminium components 67. The same gap is provided between proximate sections of the aluminium components in FIGS. 4 and 6. A break of this distance is considered to be sufficient to properly insulate between the inside and outside of a window installation, whereas gaps which are less than this amount are less efficient. Advantageously, thermal conductivity through the plastic components of the meeting rails is inefficient, so that contact between the plastic components of the meeting rails can be tolerated.

By the arrangements illustrated, it will be appreciated that as the sashes 38 and 39 move from an open position to the closed position, inter-engagement between the respective meeting rails of the sashes 38 and 39 in the overlap occurs naturally and without requiring manipulation of the sashes 38 and 39 other than to bring them to the closed position.

Returning to FIG. 5, the arrangements illustrated in FIGS. 4, 6 and 7 can be repeated at section E, so that the construction at sections D and E can be identical regardless of which form of meeting rail is employed.

Figure 8:
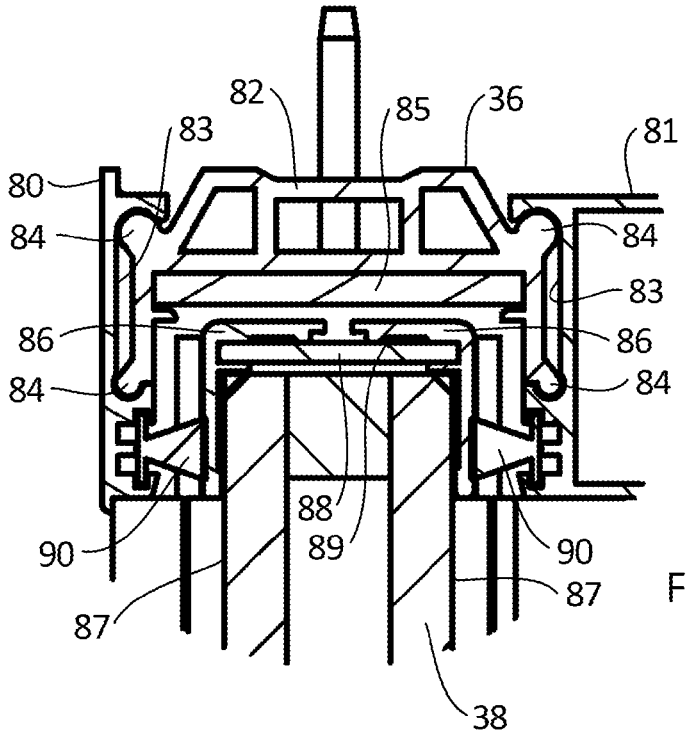
FIG. 8 is a detailed view of section B of FIG. 5.
Figure 9:
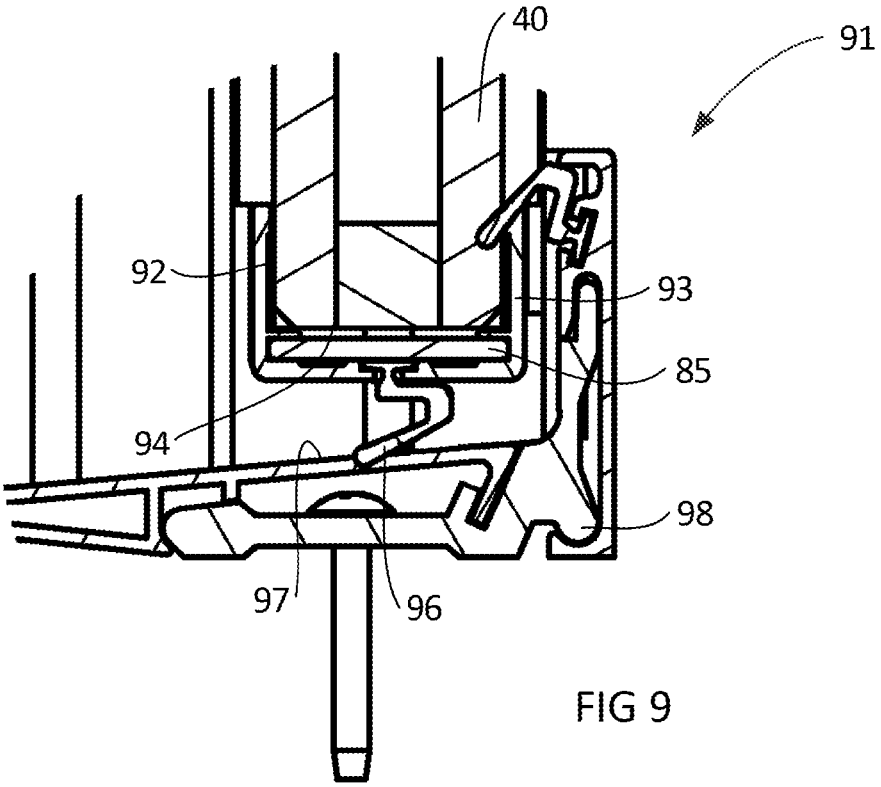
FIG. 9 is a detailed view of section C of FIG. 5.

A window according to the invention can also include thermal breaks in each of the head and sill and with reference to FIGS. 8 and 9, cross-sections through regions B and C of FIG. 5 are shown. With reference to FIG. 8, the head 36 comprises an external aluminium cover 80, an inside aluminium cover 81 and a plastic component 82. Each of the covers 80 and 81 define a recess 83 into which end sections 84 of the plastic component 82 snap or slide fit. The head 36 can thus retain outwardly an aesthetic appearance via the aluminium covers 80 and 81, but a thermal break is provided by their connection to the plastic component 82.

Additional features of the head 36 include an insulation strip 85, internal aluminium covers 86, which are formed as a right angle and which are connected to faces 87 of the sash 38 and a further plastic thermal break 88 interposed between the covers 86 and the end edge 89 of the sash 38. Seals 90 assist to insulate the seal to the upper end of the sash 38.

With reference to FIG. 9, the sill 91 is shown and this illustrates the bottom end of the sash 40. In this arrangement, aluminium covers 92 and 93 are formed in a right angle shape and are fixed to the bottom end of the sash 40 and interposed between the covers 92 and 93 and the end edge 94 of the sash 40, is a thermal break 85. A rubber or plastic seal 96 is sandwiched between opposing ends of the covers 92 and 93 and the thermal break 95 and extends into connection with a base surface 97 of the base 98.

From FIGS. 1 to 9, it can therefore be seen that thermal breaks are provided at each of the regions B to E of FIG. 5 so that aluminium covers can be employed as preferred, but without detracting from the thermal insulation that is desired for sliding windows.

A further and unique aspect of the present invention is the manner in which pulleys for sliding movement of the sashes 38 to 39 can be mounted within side jambs 100 of FIGS. 3 and 5. Reference will also be made to FIGS. 10 to 13.

Figure 11:
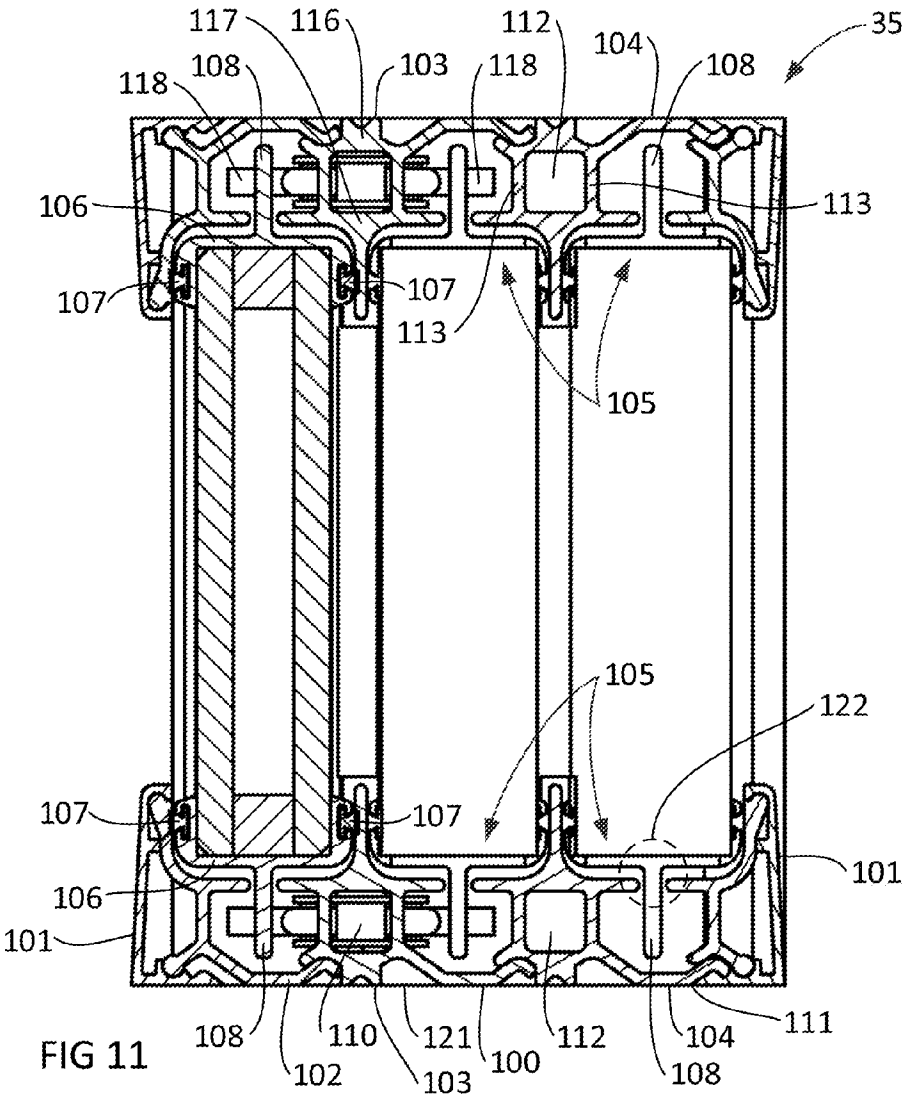
FIG. 11 is a plan cross sectional view of the window assembly of FIG. 10.

The side jambs 100 are formed of several parts that connect together depending on the number of sliding sashes to be employed. With reference to FIG. 11, the side jamb 100 includes opposite aluminium covers 101, as well as jamb sections 102 to 104. The jamb sections snap-fit together, although the type of connections made between the jamb sections and the aluminium covers is not important.

The jamb sections 102 to 104 define recesses 105 into which opposite side edges of the sashes 38 to 40 enter. These recesses guide vertical movement of the sashes 38 to 40 and end fittings 106 that attach to the opposite side edges of the sashes 38 to 40 cooperate with the jamb sections 102 to 104 to seal by way of seals 107 and fins 108. Each of the seals 107 and the fins 108 operate to resist or prevent ingress or egress of rain and wind.

Figure 10:
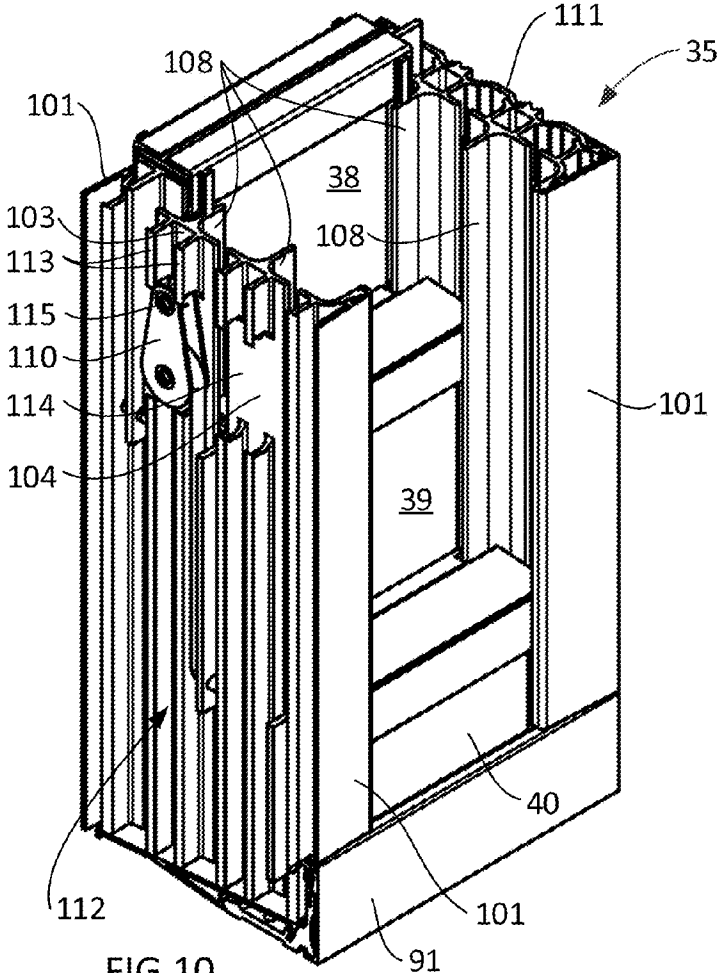
FIG. 10 is a part sectional view of a sliding window assembly according to a second aspect of the invention.

A pulley 110 is supported by the jamb section 103. From FIGS. 10 to 13, it can be seen that the jamb section 103 forms part of the outer wall 111 of the window assembly 35 and, as is clearly evident from the identical jamb section 104, the jamb sections 103 and 104 define a central hollow section 112 (see also FIGS. 10 and 13), that is defined partly by side walls 113. These side walls 113 extend for the length of the jamb sections and form a hollow box section, but to accommodate the pulley 110, an opening 114 is formed in the side walls 113, as is visible in FIGS. 10 and 13. In FIG. 10, a pulley 110 is shown accommodated in the opening (not numbered) in the jamb section 103, while the opening 114 in the jamb section 104 is open without a pulley inserted for illustrative purposes.

Figure 13:
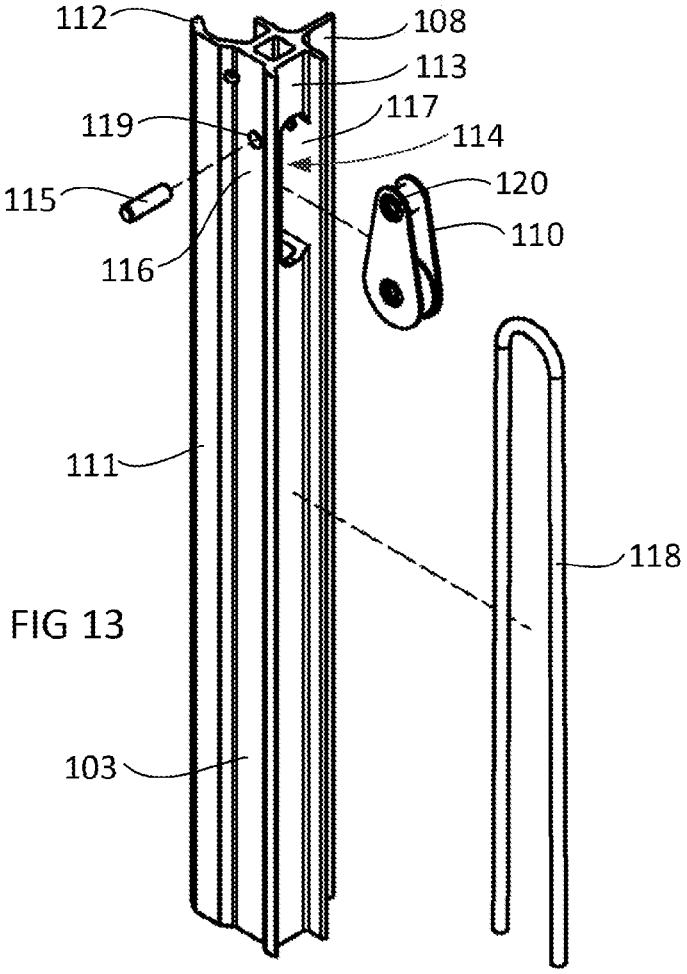
FIG. 13 is an exploded view of the jamb of FIG. 12.

FIG. 13 shows the pulley 110 separated from the opening 114, but ready for insertion into the opening 114.

Figure 12:
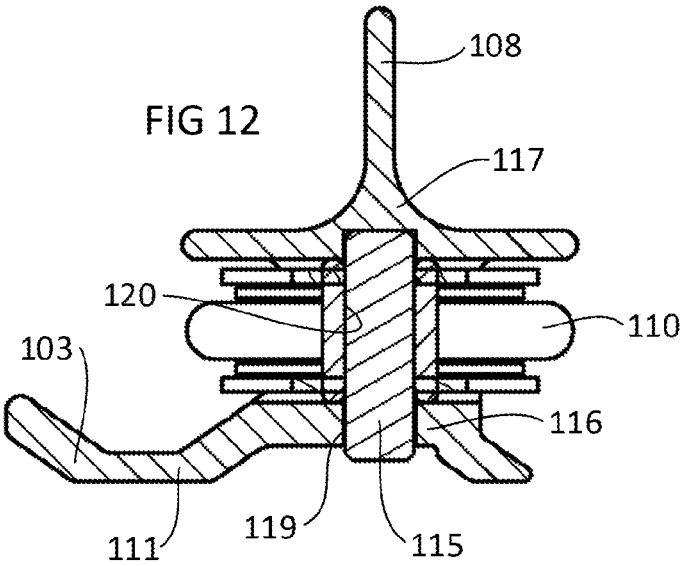
FIG. 12 is a cross sectional view of a jamb through the pin of the pulley according to the invention.

The pulley 110 is supported on a pin 115 that extends into walls 116 and 117 of the jamb section 103 (see FIGS. 10 to 12). FIG. 13 illustrates the pin 115 removed from within an opening 119 and ready for insertion into the opening 119. The pin 115 extends through an opening 120 in the upper end of the pulley 110. The pulley 110 is thus supported on either side of the hollow section 112 and is therefore firmly mounted. This means that the pin 115 is supported at opposite ends, rather than in a cantilevered manner of prior art arrangements. Cable that extends about the pulleys 110 is fixed to the sashes 38 to 40, so that movement of one sash can result in movement of another sash. The cables 118 can be fixed to the fins 108 of the end fittings 106, as shown in FIG. 11.

Advantages of the arrangement described above include that the cables 118 can be concealed within the jamb sections 102 to 104 of the side jambs 100 so as not to be visible within the window 35. Moreover, the pulleys 110 can be fitted to the relevant jamb sections prior to packaging for on-site installation, and do not require the pulley to be fitted as in the prior art, to the timber or metal external frame to which the window 35 is to be installed. Advantageously, this means that the pulleys 110 can be accurately installed relative to the side jambs 110 and the sashes 38 to 40 and do not rely on third party installers to accurately position them to the window opening within which the window 35 is to be installed.

Reference numeral 121 (FIG. 11) indicates the position of a screw fastener that can be driven through a portion of the jamb section 103 to fix that section to a surrounding window frame. A screw fastener can be inserted through the respective jamb sections 102 to 104 at the same position in each of those sections. The jamb sections 102 to 104 are fixed by screw fasteners as they are applied, so that the fixing of jamb section 102 occurs prior to the connection of jamb section 103 to jamb section 102.

Advantageously, the shape of the jamb according to the invention, in particular that shape as shown in the drawings, can conceal each of the pulley 110, the cables or cords 118 and the screws 121, so that they are not visible, or at least not easily visible once the window 35 has been installed. In this respect, the circled region shown in FIG. 11 and marked by reference numeral 122, shows that the fins 108 are closely received between facing portions of respective jamb sections, so that there is little gap for vision into the interior of the side jambs 100.

It has been referred to above that each of the plastic components of the meeting rails and the side jambs can be formed from plastic, such as fibre reinforced plastic. Other forms of plastic that can be acceptable would include fibreglass, or PVC. This is not an exhaustive list of acceptable plastics, but simply a list of plastics which are considered to be appropriate at this stage.

Moreover, the development of the invention has been made partially in respect of the provision of a thermal break to improve the insulative characteristics of a sliding window. Applicant has attempted to provide a thermal break and notes that, for a component to be classified as thermally broken, a material of low thermal conductivity (no more than 0.5 W/m·K) must be inserted between members of high conductivity to reduce heat transfer. Members of high conductivity should be separated by a low conductance material by a minimum of 5.3 mm. A window according to the invention can be constructed to have these characteristics and dimensions. In particular, the construction of the meeting rails according to the invention can have a separation or spacing between the aluminum components of about 8 mm.

Throughout the description and claims of this specification the word "comprise" and variations of that word, such as "comprises" and "comprising", are not intended to exclude other additives, components, integers or steps.

The invention described herein is susceptible to variations, modifications and/or additions other than those specifically described and it is to be understood that the invention includes all such variations, modifications and/or additions which fall within the spirit and scope of the present disclosure.

The invention claimed is:

1. A sliding window assembly including:

a window frame and at least two glass panes, at least one of which is a sliding pane which slides within the window frame between open and closed positions, wherein the panes are square or rectangular and have a first pair of parallel edges and a second pair of parallel edges generally perpendicular to the first pair of parallel edges, whereby in the closed position one of the edges of the first pair of parallel edges of each pane overlaps to form overlapping edges, first and second rails being connected to the overlapping edges of the panes and the first and second rails cooperating to form a seal in the closed position of the panes, each rail being formed from a metal component and a plastic component, the metal and plastic components being formed separate from each other and being in nesting connection to form each rail, the seal being formed between the plastic components of the first and second rails in an overlap between the overlapping edges in the closed position of the panes, the metal components of the first and second rails being spaced from contact with each other and extending to overlie outwardly facing surfaces of the first and second panes, each of the outwardly facing surfaces facing away from the overlap.

2. A sliding window assembly according to claim 1, wherein the first and second rails inter-engage in the closed position of the panes.

3. A sliding window assembly according to claim 1, wherein the metal component of each rail has a first section extending laterally to a second section, the first section overlying an end edge surface of the respective pane and the second section overlying an outwardly facing surface of the respective pane.

4. A sliding window assembly according to claim 3, wherein each of the first and second sections of the metal component are in nesting connection with the plastic component.

5. A sliding window assembly according claim 1, wherein the plastic component of each rail has a first section extending laterally to a second section, the first section overlying an end edge surface of the respective pane and the second section overlying an inwardly facing surface of the respective pane.

6. A sliding window assembly according to claim 5, wherein the second section of the plastic component includes an inter-engaging arrangement whereby with the panes in the closed position, the second sections of the plastic components of the first and second rails inter-engage.

7. A sliding window assembly according to claim 5, wherein the second sections of the plastic components define a recess between first and second walls and whereby the first and second rails inter-engage by the second walls of each recess of the plastic components being received within the recess of the other of the plastic components.

8. A sliding window assembly according to claim 7, wherein the recesses are V-shaped.

9. A sliding window assembly according to claim 8, further comprising seals that extend into contact with the first walls of the recesses to seal the inter-engagement between the first and second rails.

10. A sliding window assembly according to claim 9, wherein the seals extend from a base portion of the plastic components from which the first and second walls extend.

11. A sliding window assembly according claim 5, wherein the first section of the plastic component of each rail rests directly against the end edge surface of the respective pane to which the rail is connected.

12. A sliding window assembly according claim 1, wherein the metal and plastic components are formed to clip together for nesting connection.

13. A sliding window assembly according to claim 1, wherein the metal and plastic components are formed to slide together for nesting connection.

14. A sliding window assembly according to claim 1, wherein at least one of the at least two glass panes is a sliding pane which slides vertically within the window frame between open and closed positions, the panes forming an upper pane and a lower pane and the overlapping edges being between an upper edge of the lower pane and a lower edge of the upper pane.

15. A sliding window assembly including:

a window frame and at least two glass panes, at least one of which is a sliding pane which slides within the window frame between open and closed positions, wherein the panes are square or rectangular and have a first pair of parallel edges and a second pair of parallel edges generally perpendicular to the first pair of parallel edges, whereby in the closed position one of the edges of the first pair of parallel edges of each pane overlaps to form overlapping edges, first and second rails being connected to the overlapping edges of the panes and the first and second rails cooperating to form a seal in the closed position of the panes, each rail being formed from a metal component and a plastic component, the metal and plastic components being formed separate from each other and being in nesting connection to form each rail, the seal being formed between the plastic components of the first and second rails in an overlap between the overlapping edges in the closed position of the panes, the metal components of the first and second rails being spaced from contact with each other and extending to overlie outwardly facing surfaces of the first and second panes, each of the outwardly facing surfaces facing away from the overlap, wherein the plastic component of each rail has a first section extending laterally to a second section, the first section overlying an end edge surface of the respective pane and the second section overlying an inwardly facing surface of the respective pane opposite the outwardly facing surface of the respective pane, wherein the plastic component of each rail has a third section extending laterally to the second section, the first, second and third sections forming a C-shaped channel for receipt of an end edge of a respective pane and the third section overlying the outwardly facing surface of the respective pane.

16. A sliding window assembly according to claim 15, wherein the metal component connects to the plastic component at a free end of the third section of the C-shaped channel.

17. A sliding window assembly according to claim 16, wherein the metal component includes a short flange that extends inwardly towards the outwardly facing surface of the respective pane to which it is connected and which engages against the free edge of the end of the third section.

18. A sliding window assembly according to claim 15, wherein the metal component includes a second point of connection with the plastic component at one of the first or second sections of the C-shaped channel.

19. A sliding window assembly according to claim 18, wherein the second point of connection is provided by a recess in the plastic component for receipt of a projection of the metal component.

20. A sliding window assembly according to claim 18, wherein the second point of connection is made close to the junction between the first and second sections of the C-shaped channel.

* * * * *